US005765637A

United States Patent [19]

Dietle et al.

[11] Patent Number: 5,765,637

[45] Date of Patent: Jun. 16, 1998

[54] MULTIPLE TEST CASED HOLE FORMATION TESTER WITH IN-LINE PERFORATION, SAMPLING AND HOLE RESEALING MEANS

[75] Inventors: Lannie Dietle, Sugar Land; Manmohan S. Kalsi, Houston, both of Tex.

[73] Assignee: Gas Research Institute, Chicago, Ill.

[21] Appl. No.: 747,809

[22] Filed: Nov. 14, 1996

[51] Int. Cl.[6] ..... E21B 49/10

[52] U.S. Cl. ..... 166/55; 166/100

[58] Field of Search ..... 166/55, 55.1, 264, 166/321, 162, 100

[56] References Cited

U.S. PATENT DOCUMENTS

| | | | |
|---|---|---|---|
| 2,262,117 | 11/1941 | Roe | 166/13 |
| 2,725,283 | 11/1955 | Mounce et al. | 23/253 |
| 2,915,123 | 12/1959 | Lebourg | 166/100 |
| 3,153,449 | 10/1964 | Lebourg | 166/100 |
| 3,261,402 | 7/1966 | Whitten | 166/100 |
| 3,301,337 | 1/1967 | Vaughn et al. | 175/22 |
| 3,507,340 | 4/1970 | Voetter | 175/4.52 |
| 4,007,905 | 2/1977 | Mott | 251/1 R |
| 4,339,948 | 7/1982 | Hallmark | 73/155 |
| 4,424,865 | 1/1984 | Payton, Jr. | 166/302 |
| 4,742,459 | 5/1988 | Lasseter | 364/422 |
| 4,830,107 | 5/1989 | Rumbaugh | 166/250 |
| 4,869,321 | 9/1989 | Hamilton | 166/277 |
| 4,878,538 | 11/1989 | Christensen | 166/264 |
| 4,883,123 | 11/1989 | Zunkel et al. | 166/264 |
| 4,942,923 | 7/1990 | Geeting | 166/250 |
| 5,056,595 | 10/1991 | Desbrandes | 166/100 |
| 5,065,619 | 11/1991 | Myska | 73/152 |
| 5,195,588 | 3/1993 | Dave | 166/255 |
| 5,293,934 | 3/1994 | Burge et al. | 166/202 |
| 5,375,659 | 12/1994 | Gilbert et al. | 166/264 |

*Primary Examiner*—Frank Tsay
*Attorney, Agent, or Firm*—Dick and Harris

[57] ABSTRACT

An apparatus for perforating a wall, such as the casing wall of a well hole, taking a sample of the fluids which may be behind the wall, and subsequently sealing the perforation so formed in the wall, wherein the perforating portion, the sampling portion and the sealing portion are operably disposed in the apparatus, so as to permit all of the perforating, sampling and sealing functions to be carried out without substantial movement of the apparatus between functions.

8 Claims, 3 Drawing Sheets

MULTIPLE TEST CASED HOLE FORMATION TESTER WITH IN-LINE PERFORATION, SAMPLING AND HOLE RESEALING MEANS

BACKGROUND OF THE INVENTION

1. Field of the Invention

The present invention is directed to apparatus for testing oilfield cased holes.

2. The Prior Art

In an oil or gas well, it is customary to measure formation pressure and to sample reservoir fluid. Such testing is normally done in open well holes prior to setting the casing, and then after the well is cased, the testing process is repeated using full production testing equipment. Several tools are available to sample reservoir fluids and/or measure reservoir pressure prior to completing a well. These tools are lowered into the well on an armored electrical cable prior to the setting of the protective steel casing in that well. These tools usually have a sealing test pad that can be pressed against the formation by electrically powered hydraulics. The test pad has a probe or snorkel to penetrate the impermeable filter cake produced by drilling mud solids. Electrically controlled hydraulic valving opens the test probe to various sampling chambers and pressure measuring instruments so that a record of pressure versus time, as well as a fluid sample, can be taken from a given zone. Modern tools can take several separate samples from differing depths in order to increase the operating efficiency. The pressure measurement is recorded by the tool during each test allowing pressure transient analysis to be performed. Estimates of reservoir permeability can be made while the tool is still in the well.

There are several disadvantages to running these tools in "open-hole" before the protective casing is set. For example, the cost of the rig during testing can be prohibitive, particularly in offshore use. In addition, the drilling process typically provides for the presence of a fluid column in the open well with a slightly higher hydrostatic pressure (controlled typically by drilling fluid density) than the reservoir rock fluid pressure to prevent entry of reservoir formation fluids into the wellbore. The "overbalance," as it is called, leads to frequent differential sticking of the test tools, which necessitates the expensive and difficult task of retrieval. Sticking by this type of tool in uncased wellbores is common because of the extensive sealing pad contact area, and the fact that the tool remains motionless during the test.

A suitable tool to test reservoir pressures and sample fluids after setting the casing is therefore very desirable. In addition to the potential cost reduction for new wells, a cased hole testing tool allows the possibility to re-evaluate existing wells and examine zones that may contain hydrocarbons but were originally not the main objective. It would therefore be advantageous to make these measurements on wireline after the casing is set, without the use of production test equipment, especially to re-evaluate old wells.

The process of setting a casing involves cementing the pipe into the drilled well bore to establish a hydraulic seal by solid cement between the pipe and the formation wall to isolate zones. Cased hole formation test tools therefore must penetrate both the pipe and the cement sheath in order to establish hydraulic communication to the reservoir being tested.

Existing cased hole testing tools generally have a sealing test pad that can be pressed against the casing bore by electrically powered hydraulics.

A shaped explosive charge centered within the test pad is then used to make communication with the test zone. While effective, this method usually limits the tool to one test per trip in the well, and resealing of the resulting jagged test hole has been a significant problem. Pressure is measured from the zone using either strain or quartz pressure gauges, and a single sample of fluid can be obtained. Following the tests, the tool must be brought to the surface and redressed before additional tests can be conducted.

Dave, U.S. Pat. No. 5,195,588, discloses an apparatus in which an axially slidable gunblock contains a shaped charge perforating subsystem and a plugging subsystem at two different axial positions. After the perforation/testing function is performed, the gunblock is mechanically repositioned so the sealing function can be performed. Aside from the inherent problem of achieving a satisfactory seal against the severe irregularities caused by shaped charge perforation, the reliability of such a tool can suffer due to the inherent mechanical complexity involved with accurately moving the tool from the sampling position to the sealing position. The weight penalty associated with the mechanical complexity limits the number of gun block assemblies that can be suspended by cable.

SUMMARY OF THE INVENTION

The present invention is directed to an apparatus for the provision of at least one perforation in the wall of a substantially cylindrical hole, such as a cased well hole, and for the subsequent resealing of the at least one perforation.

The apparatus comprises a support body, having a peripheral surface; means for firing a projectile from the apparatus through the wall to form an aperture in the wall, for permitting passage through the wall of at least some fluids which may be present adjacent the side of the wall opposite the apparatus. The projectile firing means are operably disposed in the support body, and having an exit for the projectile disposed in the peripheral surface, the exit having a longitudinal axis.

Means are provided for subsequently sealing the aperture in the wall formed by the fired projectile, at least a portion of the sealing means being disposed in the support body, and positionable in alignment with the barrel and the longitudinal axis of the exit, so as to advantageously employ the exit for the projectile during sealing of the aperture, in the wall, so that the sealing of the wall may be accomplished substantially without movement of the support body subsequent to the projectile firing and prior to the sealing of the wall.

The apparatus further comprises means for permitting sampling, through the support body, of at least a portion of the fluid passing through the aperture formed by the projectile into the support body, for permitting removal of at least a portion the fluid from the support body to a location remote from the support body if desired.

In a preferred embodiment of the invention, the projectile firing means comprises a barrel, operably disposed in the support body, and substantially aligned with the exit; a projectile, positionable in alignment with in the barrel, for propelled movement along the barrel and out the exit; and means for selectively, rapidly propelling the projectile.

The means for subsequently sealing the aperture in the wall formed by the fired projectile comprise a plug member operably and movably disposable in the barrel so that the plug member may be selectively disposed in alignment with the longitudinal axis of exit; and means for propelling the plug member along the barrel and out of the exit into the aperture, subsequent to firing of the projectile firing means.

Preferably, the projectile and the plug member are operably disposed upon a movable feed block member which is selectively positionable from a position in which the projectile is aligned with the barrel and the longitudinal axis of the exit, and the plug member is not aligned with the barrel and the longitudinal axis of the exit, to a position in which the plug member is aligned with the barrel and the longitudinal axis of the exit, and the portion of the feed block member in which the projectile is held is not aligned with the barrel and the longitudinal axis of the exit.

Preferably, the means for selectively, rapidly propelling the projectile comprises an amount of chemical propellant powder operably disposed in the support body and substantially aligned with the barrel and the longitudinal axis; and means for activating the chemical propellant powder. The means for propelling the plug member comprises a hydraulic ram member operably and movably disposed in the barrel at a position such that when the plug member is positioned in alignment with the barrel and the longitudinal axis, the ram member can make contact with and propel the plug member; and means for supplying hydraulic fluid under pressure to the barrel so as to force the hydraulic ram member to propel the plug member through the barrel, and into sealing engagement with the aperture in the wall.

In a preferred embodiment of the invention, the amount of chemical propellant powder operably disposed in the support body and substantially aligned with the barrel and the longitudinal axis, is positioned substantially surrounding the hydraulic ram member.

BEST MODE FOR PRACTICING THE INVENTION

Figure 1:
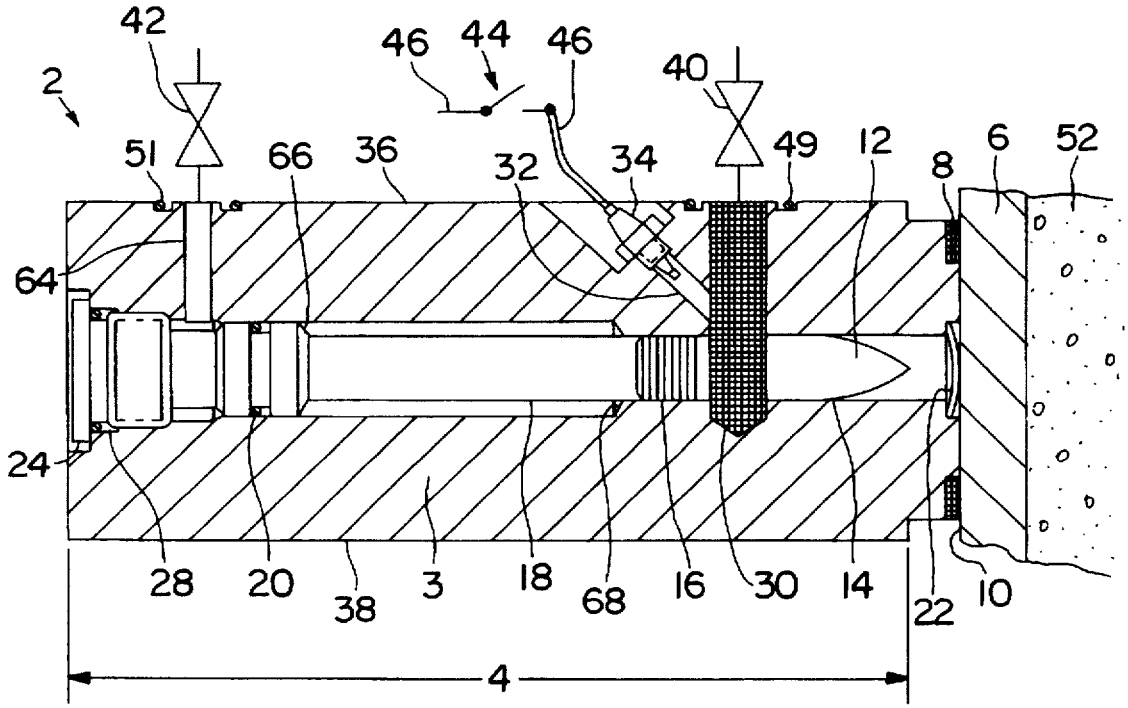
FIG. 1 is a side elevation, in section, of a testing apparatus according to a preferred embodiment of the invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Referring now to the drawings and specifically to FIG. 1, there is shown generally at 2 a cross-sectional view of the disk-like modular gun block assembly of the present invention, the body 3 of which has a generally cylindrical outer configuration, the cylinder being oriented so that the longitudinal axis of same extends vertically. The diameter of the cylindrical outer configuration is represented by reference numeral 4. A pad for contacting the side of the casing wall projects outwardly from the peripheral surface of the cylindrical body. The gun block is shown in a laterally offset position within the casing 6 of the well with the resilient sealing pad 8 of the gun block pressed firmly against the inside surface 10 of the casing to achieve a seal there-with. The offset position is achieved by electrically powered hydraulic rams which may be incorporated into the sampling tool to which the modular gun blocks are attached. Such hydraulic rams (not shown) may be of otherwise conventional configuration and are not considered to be a part of the present invention. Accordingly, such rams have been omitted from the drawings to facilitate illustration of the invention.

The gun block module 2 incorporates a stepped transverse bore 1 2 extending completely through body 3. Transverse bore 12 contains a hardened bullet/projectile, 14, a case sealing plug 16, and a hydraulic ram 18 which has a sealed relationship with stepped transverse bore 12 owing to squeeze packing seal 20. That is, that portion of bore 12 which is to the right of packing seal 20 is sealed relative to that portion of bore 12 which is to the left of packing seal 20, although seal 20 permits ram 18 to move longitudinally along bore 12, while maintaining the sealed relationship. The end of the transverse bore nearest the sealing pad 8 is sealed with a conventional front seal 22 of the type common to present day production type bullet perforator tools. The end of the transverse bore opposite the sealing pad is sealed with a removable threaded plug 24 which has a sealed relationship with the body 3 of the gun block 2 by virtue of squeeze packing seal 28. The transverse bore 12 is intersected by a vertical powder chamber 30 containing propellant. One end of the powder chamber is intersected by a communication hole 32 which communicates between an ignition device 34 and the powder chamber 30. The communication hole 32 may alternately communicate with the opposite (i.e., upper) end of the powder chamber if desired. The ignition device 34 may be of any suitable type, such as an electrically actuated chemical priming device, a miniature electric glow plug, or a conventional impact-ignited Boxer or Berdan type primer which is ignited by impact from a spring loaded firing pin that is triggered by electrical or hydraulic actuation.

The upper 36 and lower 38 surfaces of the modular gun block may be generally planar in shape for convenient bolted attachment to adjacent modular control sections (not shown) which contain valving devices, ignition control devices, and communication devices; the devices being provided for controlled ignition of the propellant, for control of sampling, and for control of plugging of the casing perforation. Although the adjacent modular control sections are not shown, their construction may be of otherwise conventional configuration, and the functions thereof are schematically represented by a sampling valve 40, a hydraulic control valve 42, and a switch 44 which is connected to the ignition device 34 by wire 46 and to an electrical current source (not shown) by wire 48. The powder chamber is sealed to a mating passage in the control section (not shown) by squeeze packing seal 49, and the communication passage 64 is sealed to a mating passage in the control section by squeeze packing seal 51. Propellant ignition is accomplished by closing switch 44 to electrically activate the ignition device 34, which ignites the propellant in the powder chamber 30. Prior to and during ignition, the hydraulic control valve 42 is closed to prevent hydraulic actuation of the hydraulic ram 18, and the sampling valve 40 is closed to contain the gases created by propellant combustion. The gas pressure resulting from propellant combustion acts on the base of the projectile 14 and also upon the casing plug 16. The casing plug 16 is prevented from movement by its abutment with the hydraulic ram 18, which in turn is supported against movement by the threaded plug 24. If desired, the casing plug 16 can be constructed of a suitable malleable material so that the gas pressure acting on it causes it to obturate/upset to the full size of the portion of the transverse bore within which it is seated. The gas pressure resulting from propellant combustion drives the projectile 14 through the front seal 22, the casing wall 6, and the cement 52 and on into the formation (not shown) to yield a perforation suitable for sampling. The hole produced in the casing wall by the projectile 14 is of a relatively uniform cylindrical shape. Compared to the jagged shape typically produced by shaped charges, the bullet hole provides a far superior controlled geometry, which greatly facilitates the provision of a reliable and positive seal.

Figure 2:
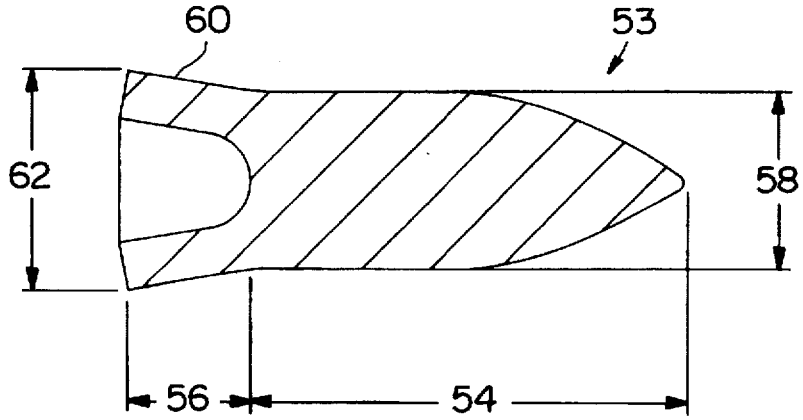
FIG. 2 is a side elevation, in section, of a test projectile for use with the apparatus according to FIG. 1.

Although a homogeneous hardened projectile 14 is depicted in FIG. 1, the projectile can optionally have a composite nature, wherein a thin outer layer of the projectile is a relatively soft material, and the inner core is hardened. The thin, relatively soft outer layer provides a seal with the bore during propellant ignition, but is stripped off as the projectile passes through the casing, so that the hole produced by the projectile is slightly smaller than the original diameter of the projectile. The projectile can also alternately take the form shown in the cross-sectional depiction of FIG. 2, where a projectile shown generally at 53 has a hardened portion of length 54 and diameter 58 and an annealed flared skirt 60 portion of length 56 which flares out to diameter 62. The angle of flare is exaggerated for clarity. Upon ignition, the flared skirt provides a sliding combustion gas seal with the bore (FIG. 1 item 12) of the gun body, while diameter 58 provides a clearance with the bore of the gun body. Upon impact with the casing, a hole is produced in the casing having a diameter which is a function of the hardened diameter 58 and which is therefore slightly smaller than the bore of the gun body and the outer diameter of the casing plug. When the annealed skirt 60 portion of the projectile enters the casing hole produced by projectile diameter 58, it yields or flexes to conform with the casing hole diameter, and does not significantly enlarge the casing hole diameter produced by diameter 58 of the projectile.

Figure 3:
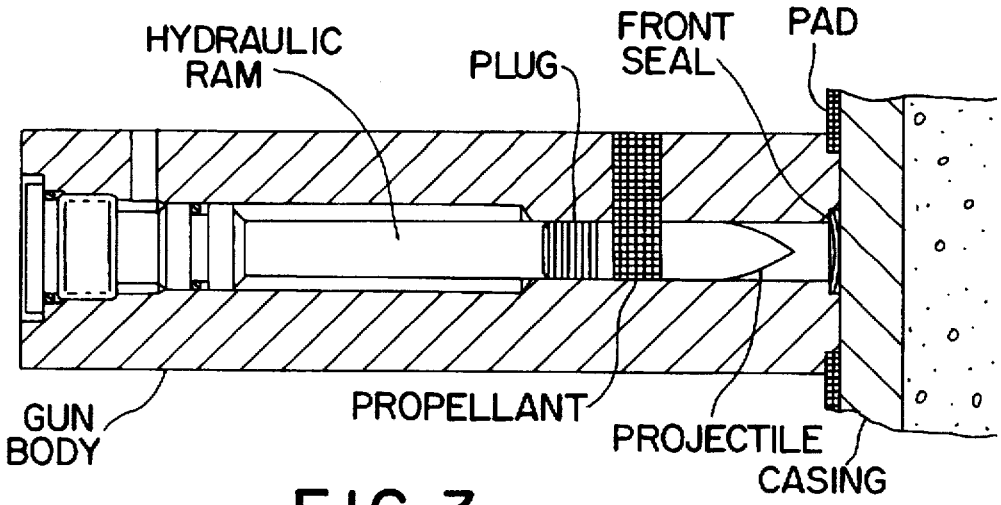
FIG. 3 illustrates the apparatus of the present invention, in the alignment and perforation step of the process of the present invention.
Figure 4:
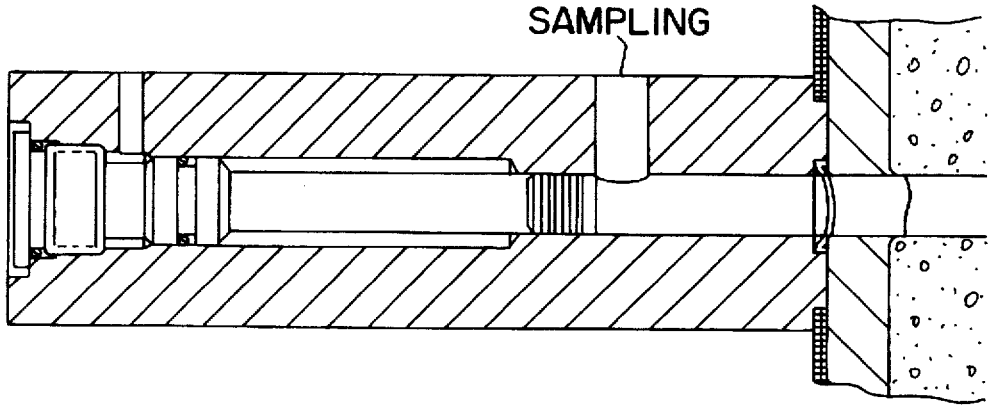
FIG. 4 illustrates the apparatus of the present invention, in the sampling step of the process of the present invention.
Figure 5:
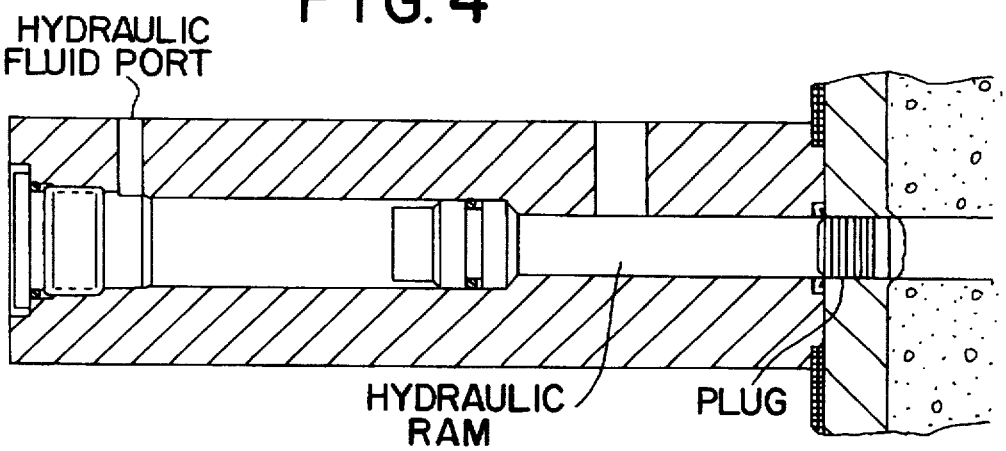
FIG. 5 illustrates the apparatus of the present invention, in the resealing step of the present invention.

The process is illustrated in FIGS. 3–5. In FIG. 3, the test apparatus is positioned for firing. After the firing of the projectile produces a hole through the casing wall and through the cement and on into the formation, pressure tests are performed and fluid samples are taken through the now empty powder chamber (previously occupied by the propellant) by opening the sampling valve 40, which provides fluid communication to sampling and pressure sensing devices which are incorporated, into the sampling tool to which the modular gun block and control block are attached. See FIG. 4. The pressure sensing and sampling devices can be of conventional configuration and are not considered to be part of the present invention.

After testing is completed, valve 40 may be closed, then the hydraulic valve 42 is opened, which via hydraulic communication hole 64 introduces hydraulic pressure between the plug threaded plug 24 and the hydraulic ram 18, causing a controlled displacement of hydraulic ram 18 which presses the casing plug 16 into the casing hole and seals it, causing an interference fit of sufficient magnitude that the resultant frictional forces keep the casing plug in place against differential pressure in either direction. See FIG. 5. Forward motion of the hydraulic ram 18 is arrested by contact between the stop shoulder 66 of the hydraulic ram and stop shoulder 68 of the transverse hole 12, thereby establishing the controlled displacement necessary to insure that the casing plug is seated at the desired depth into the casing wall.

A number of the compact modular gun blocks of the present invention can be stacked in tandem with an equal number of adjacent modular control sections to achieve multiple tests per trip into the well. The transverse bore 12 occupies only a small portion of the disk (or cylinder)-like gun block body 3, therefore the remaining portion of each gun block body can conveniently be penetrated by a multiplicity of longitudinal holes to provide bolting devices to adjacent components, and to provide the fluid communication devices and electrical communication devices required for operation of additional gun blocks and control sections.

Figure 6:
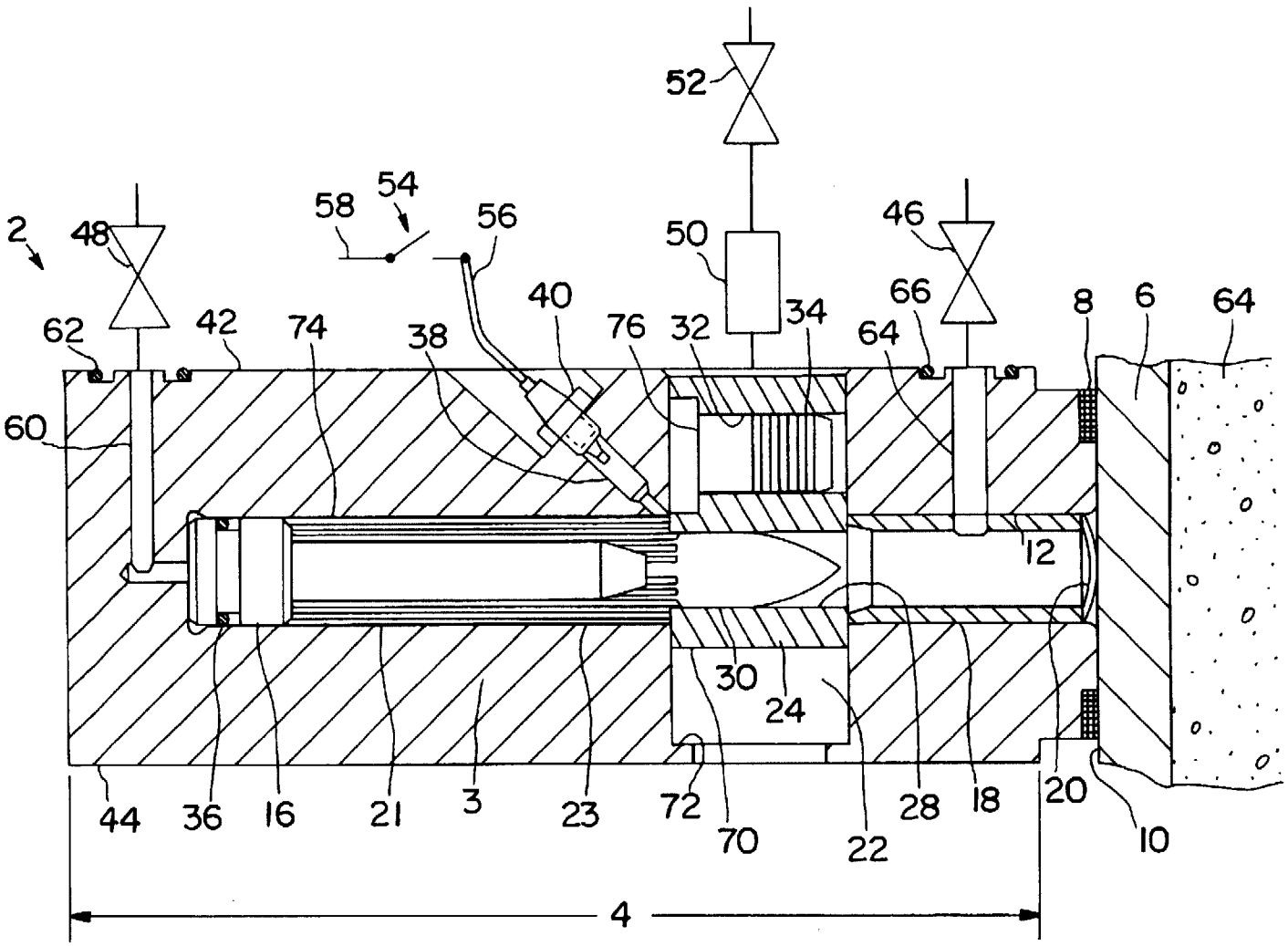
FIG. 6 is an elevation, in section, of the tester apparatus according to a further preferred embodiment of the invention.

Referring now to FIG. 6, there is shown an alternative preferred embodiment of the invention, in which elements like to those illustrated with respect to the prior embodiment are provided with like reference numerals. There is shown generally at 2 a cross-sectional view of the disk-like modular gun block assembly of the present invention, the body 3 of which has a generally cylindrical outer cylindrical configuration of diameter 4. The gun block is shown in a laterally offset position within the casing 6 of the well with the resilient sealing pad 8 of the gun block pressed firmly against the inside diameter 10 of the casing to achieve a seal there-with. This offset position is achieved by electrically powered hydraulic rams which are incorporated into the sampling tool to which the modular gun blocks are attached. These hydraulic rams (not shown) may be of a known type and are not considered to be a part of tie present invention, and accordingly have been omitted from the illustrations.

The gun block module incorporates a transverse bore 12 extending partially through body 8. Transverse bore 12 houses a hydraulic ram 16, a barrel 18, and an end seal 20. A powder chamber 21 containing propellant is defined between ram extension 23 and bore 12. Hydraulic ram 16 has a sealed relationship with bore 12 by virtue of sliding seal 36. Transverse bore 12 is intersected by vertical cavity 22 which houses a feed block 24 which is penetrated by bore 28 which houses a hardened bullet/penetrator 30. Feed block 24 is also penetrated by bore 32 which houses casing plug 34. The transverse bore 12 is intersected by a communication hole 38 which communicates between an ignition device 40 and the powder chamber 21. The ignition device 40 may be of any suitable type, such as an electrically actuated chemical priming device or a conventional impact-ignited Boxer or Berdan type primer which is ignited by impact from a spring loaded firing pin that is triggered by electrical or hydraulic actuation.

The upper 42 and lower 44 surfaces of the modular gun block are generally planar in shape for convenient bolted attachment to adjacent modular control sections (not shown) which contain valving devices, ignition control devices, communication devices, and hydraulic actuation devices; the devices being provided for control of ignition of the propellant, for control of sampling, and for control of plugging of the casing perforation and for control of movement of feed block 24. Although the adjacent modular control sections are not shown, their construction may be of otherwise conventional configuration, and the functions thereof are schematically represented by a sampling valve 46, a ram hydraulic control valve 48, a linear hydraulic actuator 50, an actuator control valve 52, and a switch 54 which is connected to the ignition device 40 by wire 56 and to an electrical current source (not shown) by wire 58. The hydraulic passage 60 is sealed to a mating passage in the control section by squeeze packing seal 62, and the sampling passage 64 is sealed to a mating passage in the control section by squeeze packing seal 66. Propellant ignition is accomplished by closing switch 54 to electrically activate the ignition device 40, which ignites the propellant in the powder chamber 21. Prior to and during ignition, the sample control valve 46 is closed to contain the gases created by propellant combustion. The gas pressure resulting from propellant combustion acts on the base of the projectile 30 and also upon the hydraulic ram 16. The hydraulic ram 16 is prevented from movement by its abutment with the closed end of transverse bore 12. The gas pressure resulting from propellant combustion drives the projectile 30 through the front seal 20, the casing wall 6, and the cement 64 and on into the formation (not shown) to yield a perforation suitable for sampling. The hole produced in the casing wall by the projectile 30 is of a relatively uniform cylindrical shape. Compared to the jagged shape produced by shaped charge, the bullet hole provides a far superior controlled geometry, which greatly facilitates the provision of a reliable and positive seal.

The projectile itself may have a configuration like those described with respect to the previously discussed embodiments, and so further discussion of the projectile is not necessary here.

After the firing of the projectile produces a hole through the casing wall and through the cement and on into the formation, pressure tests are performed and fluid samples are taken through passage 64 by opening the sampling valve 46, which provides fluid communication to sampling and pressure sensing means which are incorporated into the sampling tool to which the modular gun block and control block are attached. The pressure sensing and sampling devices can be of conventional configuration and are not considered to be part of the present invention.

After testing is completed, valve 46 may be closed, then the hydraulic valve 52 is opened, which via hydraulic actuator 50 moves feed block 24 downward so that bore 32 is aligned with bore 12. Travel of feed block 24 may be stopped by impact between end surface 70 and stop shoulder 72, or by other suitable means. After bore 32 is aligned with bore 12, valve 48 is opened to introduce hydraulic pressure through communication hole 60 to the base of hydraulic ram 16, causing a controlled displacement of hydraulic ram 16 which presses the casing plug 34 into the casing hole and seals it, causing an interference fit of sufficient magnitude that the resultant frictional forces keep the casing plug in place against differential pressure in either direction. Forward motion of the hydraulic ram 16 is arrested by contact between the stop shoulder 74 of the hydraulic ram and stop shoulder 76 of the feed block, thereby establishing the controlled displacement necessary to insure that the casing plug is seated at the desired depth into the casing wall.

A number of the compact modular gun blocks of the present invention can be stacked in tandem with an equal number of adjacent modular control sections to achieve multiple tests per trip into the well. The above described internal geometry occupies only a small portion of the disk-like gun block body 3, therefore the remaining portion of each gun block body can conveniently be penetrated by a multiplicity of longitudinal holes to provide bolting means to adjacent components, and to provide the fluid communication means and electrical communication means required for operation of additional gun blocks and control sections.

The foregoing description and drawings merely explain and illustrate the invention, and the invention is not limited thereto except insofar as the appended claims are so limited, as those skilled, in the art who have the disclosure before them will be able to make modifications and variations therein without departing from the scope of the invention.

We claim:

1. An apparatus for the provision of at least one perforation in the wall of a substantially cylindrical hole, such as a cased well hole, and for the subsequent resealing of the at least one perforation, the apparatus comprising:

a support body, having a peripheral surface;

means for firing a projectile from the apparatus through the wall to form an aperture in the wall, for permitting passage through the wall of at least some fluids which may be present adjacent the side of the wall opposite the apparatus, the projectile firing means being operably disposed in the support body, and having an exit for the projectile disposed in the peripheral surface, the exit having a longitudinal axis;

means for subsequently sealing the aperture in the wall formed by the fired projectile, at least a portion of the sealing means being disposed in the support body, substantially proximate the projectile firing means and further being positionable into substantial alignment with the longitudinal axis, so as to advantageously employ the exit for the projectile during sealing of the aperture in the wall, so that the sealing of the wall may be accomplished substantially without movement of the support body subsequent to the projectile firing and prior to the sealing of the wall.

2. The apparatus according to claim 1, further comprising:

means for permitting sampling, through the support body, of at least a portion of the fluid passing through the aperture formed by the projectile into the support body, for permitting removal of at least a portion the fluid from the support body to a location remote from the support body if desired.

3. The apparatus according to claim 1, wherein the projectile firing means comprises:

a barrel, operably disposed in the support body, and substantially aligned with the exit;

a projectile, positioned in alignment with the barrel, for propelled movement along the barrel and out the exit;

means for selectively, rapidly propelling the projectile.

4. The apparatus according to claim 3 wherein the means for subsequently sealing the aperture in the wall formed by the fired projectile comprise:

a plug member operably and movably disposable in the barrel so that the plug member may be selectively disposed in alignment with the longitudinal axis of exit; and means for propelling the plug member along the barrel and out of the exit into the aperture, subsequent to firing of the projectile firing means.

5. The apparatus according to claim 4 wherein the projectile and the plug member are operably disposed upon a movable feed block member which is selectively positionable from a position in which the projectile is aligned with the barrel and the longitudinal axis of the exit, and the plug member is not aligned with the barrel and the longitudinal axis of the exit, to a position in which the plug member is aligned with the barrel and the longitudinal axis of the exit, and the portion of the feed block member in which the projectile is held is not aligned with the barrel and the longitudinal axis of the exit.

6. The apparatus according to claim 3, wherein the means for selectively, rapidly propelling the projectile comprises:

an amount of chemical propellant powder operably disposed in the support body and substantially aligned with the barrel and the longitudinal axis; and means for activating the chemical propellant powder.

7. The apparatus according to claim 6, wherein the means for propelling the plug member comprises:

a hydraulic ram member operably and movably disposed in the barrel at a position such that when the plug member is positioned in alignment with the barrel and the longitudinal axis, the ram member can make contact with and propel the plug member; and means for supplying hydraulic fluid under pressure to the barrel so as to force the hydraulic ram member to propel the plug member through the barrel, and into sealing engagement with the aperture in the wall.

8. The apparatus according to claim 7, wherein the amount of chemical propellant powder operably disposed in the support body and substantially aligned with the barrel and the longitudinal axis, is positioned substantially surrounding the hydraulic ram member.

* * * * *